United States Patent [19]

Nihei et al.

[11] Patent Number: 4,651,550

[45] Date of Patent: Mar. 24, 1987

[54] METHOD OF DECREASING WIDTH OF THIN SLAB AND APPARATUS THEREFOR

[75] Inventors: Mitsuo Nihei; Tomoaki Kimura, both of Hitachi, Japan

[73] Assignee: Hitachi, Ltd., Tokyo, Japan

[21] Appl. No.: 673,786

[22] Filed: Nov. 21, 1984

[30] Foreign Application Priority Data

Nov. 28, 1983 [JP] Japan ..... 58-222051
Dec. 8, 1983 [JP] Japan ..... 58-232090

[51] Int. Cl.[4] ..... B21D 3/12; B21B 15/00

[52] U.S. Cl. ..... 72/183; 72/199; 72/206; 72/377; 72/710

[58] Field of Search ..... 72/183, 206, 205, 199, 72/207, 365, 366, 402, 377

[56] References Cited

U.S. PATENT DOCUMENTS

| | | | |
|---|---|---|---|
| 2,178,674 | 11/1939 | Simons | 72/243 |
| 2,633,893 | 4/1953 | Philippi | 72/183 |
| 3,013,451 | 12/1961 | Scribner | 72/377 |
| 3,143,009 | 8/1964 | Pfeiffer | 72/205 |

FOREIGN PATENT DOCUMENTS

| | | | |
|---|---|---|---|
| 499909 | 1/1976 | U.S.S.R. | 72/199 |
| 608593 | 5/1978 | U.S.S.R. | 72/710 |
| 1028397 | 7/1983 | U.S.S.R. | 72/199 |

*Primary Examiner*—Daniel C. Crane
*Attorney, Agent, or Firm*—Beall Law Offices

[57] ABSTRACT

For decreasing the width of a thin slab: a turning roll contacts the thin slab being conveyed at a certain contact angle to curve the thin slab; a tension applying device disposed in front and at the back of the turning roll, applys a tension to the thin slab forwardly and rearwardly in the direction of conveyance of the slab. Thus, the slab can be decreased in its width to a satisfactory section with no buckling loop forming portions for forming loops of the hot thin slab at the inlet and the outlet sides of the apparatus for decreasing the width of the thin slab absorb the intermittent proceeding of the hot thin slab in the direction of flow of the material. Thus, the continuous receipt and the delivery of the slab are made possible while the intermittent width decrease is performed, and the combination of the continuous casting equipment with the hot finish rolling equipment is materialized.

13 Claims, 15 Drawing Figures

METHOD OF DECREASING WIDTH OF THIN SLAB AND APPARATUS THEREFOR

BACKGROUND OF THE INVENTION

This invention relates to a method and an apparatus capable of satisfactorily conducting reduction of a thin slab, particularly a hot thin slab to a considerable extent in the widthwise direction so as to decrease the width thereof.

As a conventional method of adjusting the breadth or width of a hot slab, there is the method of conducting the reduction of a relatively thick slab (having a thickness of 200 mm and a width of 1500 mm for example) by vertical type rolls installed in front of a group of rough rolling mills of a hot rolling equipment in the widthwise direction by use of an equipment described in Japanese Patent Kokai (Laid-Open) No. 114501/81.

However, according to this method of adjusting the width, the value of width decrease by one pass was limited to 100 mm, whereby, in order to decrease the plate width of the slab from 1500 mm to 1300 mm (i.e. the value of width decrease is 200 mm), it was necessary to conduct two passes or more. Moreover, since the rolling was made by the vertical type rolls, extremely thick portions (hereinafter referred to as "dogbones") occurred at portions adjacent opposite ends of plate width. If horizontally rolled thereupon, then the dogbone portions flowed, spreading in the plate widthwise direction, which were called width spread phenomena. Thus, there was presented such a drawback that the efficiency of width decrease was lowered.

Furthermore, at the forward and rear ends of the slab, there occurred the longitudinal expansions of only opposite end portions in the plate widthwise direction, the so-called fishtails. For this, the dogbones are lessened in size at the front and rear ends of the slab at the same time. Therefore, the width spread phenomena by the subsequent horizontal rollings are small in value at the forward and rear ends of slab. Hence, there have been presented such disadvantages that the slab is lessend in its width and the fishtails are further expanded, so that the yield is lowered to a considerable extent. Further, recently, there has been a demand for continuous casting of slab of thin thickness (thickness of 30 to 50 mm for example). In this case, with the above-described method, there has been presented such a drawback that a buckling tends to occur in the widthwise direction of slab.

On the other hand, there is a method of changing the width of slab in a continuous casting equipment, and, in many continuous casting equipments, moulds are replaced to change the width of slab. However, this method has been considerably disadvantageous in that the casting operation should be stopped during the replacement of the moulds, whereby the casting efficiency is low and the production is lowered. Therefore, the replacement of the moulds made it difficult to efficiently manufacture slabs of various widths.

Recently, there has been developed a technique, according to which the width of slab is changed during casting, without the replacement of moulds. However, there still remain the problems in the material quality of the surface of cast slab and the leakage of molten steel. Further, if the change of width is made suddenly, then there occurs a problem of a breakout, etc. due to an incomplete formation of a solidified shell. Hence, the change of width has had to be made slowly. In consequence, the slab in the widthwise direction during the change of width is formed into a tapered shape, and, even at a casting speed of about 1 m/min, the length of a portion being of the tapered shape reaches about 10 m or more when the width of slab is changed from 1500 mm to 1300 mm.

Further, recently, the adoption of high casting speed has been studied. In this case, the tapered portion is further lengthened. In consequence, there are presented such disadvantages that it becomes necessary to adjust the tapered portion in its width during a later process, whereby the number of man-hours must be increased.

As described above, the conventional method of decreasing the width of a hot slab, particularly a thin slab, either in the rolling by the vertical type rolls or by the means of changing the width in the continuous casting equipment, has been disadvantageous in that the decrease of width cannot be carried out efficiently.

In addition, as a system for decreasing the occurrences of fishtails in the rollings in the widthwise direction of slab, such an apparatus is well known that a press device for decreasing the width of the end portions in the plate widthwise direction of slab is provided upstream of the vertical type rolls as shown in Japanese Patent Kokai (Laid-Open) No. 68504/81.

SUMMARY OF THE INVENTION

One object of the present invention is to provide a method of decreasing the width of a slab and a apparatus therefor, which are suitable for decreasing the width of the slab into a good shape in cross section without causing a buckling to a hot slab, particularly to a thin slab.

The method of decreasing the width of a thin slab according to the present invention features that the thin slab being conveyed is curved at a predetermined portion with respect to the direction of conveyance of the slab to give a tension to the curved portion in the longitudinal direction of conveyance of the slab, and the slab is pressed at the curved portion in the widthwise direction of slab.

Furthermore, the apparatus for decreasing the width of a thin slab according to the present invention comprises: a turning roll for curving the thin slab in the vertical direction with respect to the direction of conveyance of the slab; a tension applying device for applying a tension to the slab; and a press device for pressing the curved portion of slab in the widthwise direction, which has been curved by the turning rolls.

The adoption of the above-described arrangement makes it possible to achieve the aforesaid object.

Another object of the present invention is to provide an apparatus for decreasing the width of a thin slab, particularly a hot thin slab, wherein the continuous receipt and delivery of the slab are made possible by use of means for intermittently decreasing the width, and the combination of a continuous casting equipment with a hot finish rolling equipment is materialized.

Loop forming portions for forming loops of the hot thin slab are provided on the inlet and the outlet sides of the apparatus for decreasing the width of the thin slab in order to absorb the intermittent processing in the direction of material flow of the hot thin slab.

DESCRIPTION OF THE PREFERRED EMBODIMENT

The outline of the history of development of the present invention will hereunder be described prior to the description of the embodiments.

As has been described hereinabove, the problem considered to be difficult about the method of decreasing the breadth or width of a thin slab may be broadly divided into the following items.

(1) Bucklings tend to occur when the width is decreased by a large value because the ratio of thickness/-width is small.

(2) When the vertical type rolls are used in rolling, dogbones occur at portions adjacent opposite ends of plate width, the width spreads are caused by the subsequent horizontal rollings, whereby the efficiency of adjusting the breadth is lowered, so that the slab is formed into one having narrow widths at the forward and rear ends of slab, thus notably lowering the yield.

Then, the inventors of the present invention have achieved the invention, based on the following points (1), (2) and (3), to be described hereunder. (1). The width of a thin slab is decreased while being given a curvature in the direction of conveyance of the slab, whereby a buckling load can be increased.

As for the buckling, according to Euler's formula, an elastic buckling load $W_o$ is given by:

$$W_o = \frac{n\pi^2 EI}{l^2}$$

where n is a coefficient determined by an end condition of a column, E a modulus of longitudinal elasticity, I a secondary moment of principal section, and l a length of a long column.

Additionally, in the case of a plastic buckling, the modulus of longitudinal elasticity E in Euler's formula is substituted by a reduced modulus $E_r$, whereby a plastic buckling load $W_p$ is given by:

$$W_p = \frac{n\pi^2 E_r I}{l^2}$$

Figure 1A:
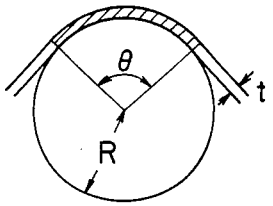
FIGS. 1A and 1B show a curved section and a rectangular section of the slabs, to which a buckling load is applied, being equal to each other in the sectional area.
Figure 1B:
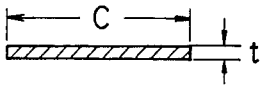

Now in comparison of the buckling loads between a plate member having a plate thickness t of 30 mm, a length (arcuate length) of 1570 mm and a section curved ($\theta = 90°$) along a circle having a radius R (=1000 mm) as shown in FIG. 1A and another plate member being rectangular in section, having a plate thickness (vertical) t of 30 mm, a length (lateral) c of 1570 mm and a section equal in sectional area to the above-mentioned curved section as shown in FIG. 1B, the result is given as the ratio between the secondary moments of principal sections. If the secondary moment of principal section of the former is given as $I_1$ and that of the latter as $I_2$, then the result is obtained by:

$$I_1 = R^3 t\left(\frac{\theta}{2} + \sin\frac{\theta}{2}\cdot\cos\frac{\theta}{2} - \frac{2\sin^2\frac{\theta}{2}}{\left(\frac{\theta}{2}\right)}\right)$$

$$= 3.95 \times 10^8$$

On the other hand, $$I_2 = \frac{Ct^3}{12} = 3.53 \times 10^6$$

In consequence, $I_1/I_2 \approx 110$, whereby it is found that the former (curved one) is by far larger in buckling load and not easily buckled.

(2) A tension forwardly and rearwardly in the direction of conveyance of the slab is given to the thin slab, so that the width of slab can be decreased.

Figure 2:
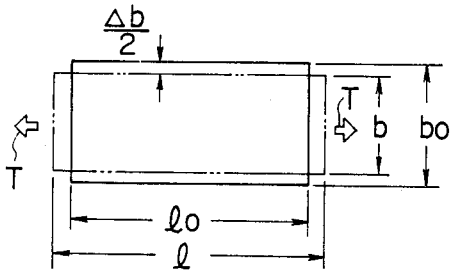
FIG. 2 is a plan view showing a tension acting on the slab having the rectangular section and the value of shrinkage.

Now, if the dimensions of the slab prior to being applied thereto with a tension are thickness ($h_o$)×width ($b_o$) and length ($l_o$) and the dimensions of the slab after a tension T in the direction of conveyance of the slab are h×b×l as shown in FIG. 2, then $$\frac{h}{h_o}\cdot\frac{b}{b_o}\cdot\frac{l}{l_o} = 1$$

because the volume is constant. This leads to $$\ln\frac{h}{h_o} + \ln\frac{b}{b_o} + \ln\frac{l}{l_o} = 0.$$

This means that, if distortions in the directions of the thickness, width and length are $\epsilon_h$, $\epsilon_b$ and $\epsilon_l$, respectively, then $\epsilon_h + \epsilon_b + \epsilon_l = 0$.

Now, if the slab is considered to be isotropic, then $\epsilon_b = \epsilon_h$, and hence, $$\ln\frac{l}{l_o} = \epsilon_l = -2\ln\frac{b}{b_o}.$$

According to the above, the value of decreased width $\Delta b$ is given by:

$$\Delta b = b_o\left(1 - e^{-\frac{\epsilon l}{2}}\right)$$

For example, when the slab is of a low carbon steel, $b_o$ is 1500 mm and the temperature is 1100° C., if the tension is 3 kg/mm$^2$, $\epsilon_l$ is about 0.05 from a stress-strain curve and the value of reducing the width $\Delta b$ becomes about 37 mm.

In other words, the tension is applied forwardly and rearwardly in the direction of conveyance of the slab, so that the effect of decreasing the width can be facilitated.

(3) When the press work is conducted on press surfaces but not on circular outer surfaces as in the vertical type rolls, the deformation reaches the interior. Therefore, if the press work of the thin slab is conducted by press tools having pressing surfaces being almost planar in the widthwise direction of the slab, then the dogbones occur close to the center of the plate width.

The present invention has been developed, being based on the above-described three points. The method of decreasing the width of a thin slab according to the first aspect of the present invention features that the thin slab being conveyed is curved at a predetermined portion thereof in the direction of conveyance of the slab, a tension is applied to the curved portion in the longitudinal direction of conveyance of the slab, and the slab is pressed at the curved portion in the widthwise direction thereof. On the other hand, the apparatus for decreasing the width of a thin slab according to the second aspect of the present invention features that the apparatus comprises: a turning roll for curving the thin slab being conveyed in the vertical direction with respect to the direction of conveyance of the slab; a tension applying device for applying a tension to the slab; and a press device for pressing the curved portion of the slab, which has been curved by the turning roll.

Description will hereunder be given of the embodiments of the present invention with reference to the drawings.

Figure 3:
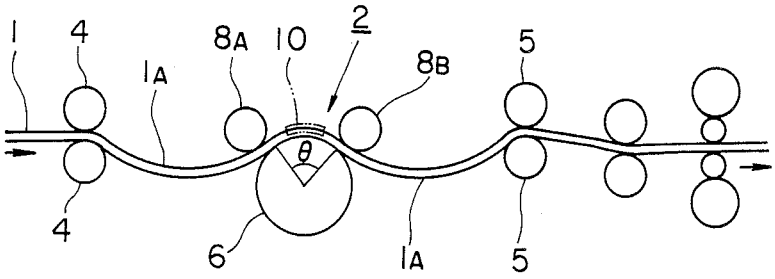
FIG. 3 is a schematic diagram showing one embodiment of the apparatus for decreasing the width of a slab according to the present invention.

FIG. 3 shows an apparatus for working the method of decreasing the width of a thin slab according to the present invention, which is a first embodiment of the apparatus for decreasing the width of a thin slab according to the second aspect of the present invention.

In FIG. 3, a hot thin slab 1, which has been produced by a continuous casting equipment, not shown, is directly or after being cast, cut in the longitudinal direction, or wound into a coil shape and inserted into a furnace, where it is heated. Thereafter, the slab 1 goes out of the furnace and is conveyed to an apparatus 2 for decreasing the width of the slab. Inlet pinch rolls 4 are provided in front of the width decreasing apparatus 2, while, outlet pinch rolls 5 are disposed at the back of the width decreasing apparatus 2, whereby the thin slab 1 is reliably delivered to the width decreasing apparatus 2 and conveyed to the succeeding process.

The width decreasing apparatus 2 comprises: a turning roll 6 turning in contact at a contact angle $\theta$ with the thin slab 1; tension rolls 8 (8A and 8B) as being a tension applying device, being disposed at a contact beginning and a contact ending portions, where the contact between the thin slab 1 and the turning roll 6 begins and ends, for pressing the thin slab 1 against the turning roll 6 to apply a tension to the thin slab 1; and press tools 10 (Refer to FIG. 4) expandable and shrinkable in the widthwise direction of the slab along the outer surface of the turning roll 6.

The turning roll 6 performs the function of holding the slab at a predetermined curvature. The tools 10 press the slab 1 in the widthwise direction of the slab in a state where the slab 1 is curved by roll 6 in a manner to be upwardly convex, so that the bucklings do not easily occur.

Figure 5A:
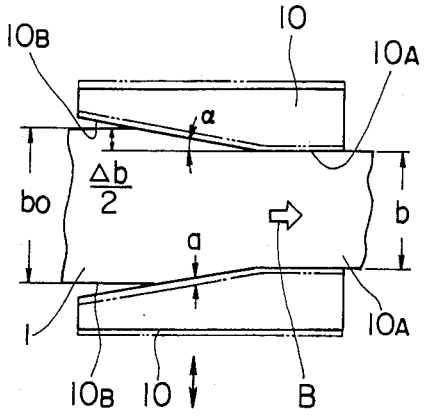
FIG. 5A and 5B show the expanding and shrinking actions of press tools in the apparatus for decreasing the width of a slab.

As shown in FIG. 5A, a value of the tension applied to the slab 1 by the tension rolls 8 is set in accordance with the value $\Delta b$ (a difference between a plate width $b_o$ on the inlet side and a plate width b on the outlet side of the thin slab 1).

Figure 4:
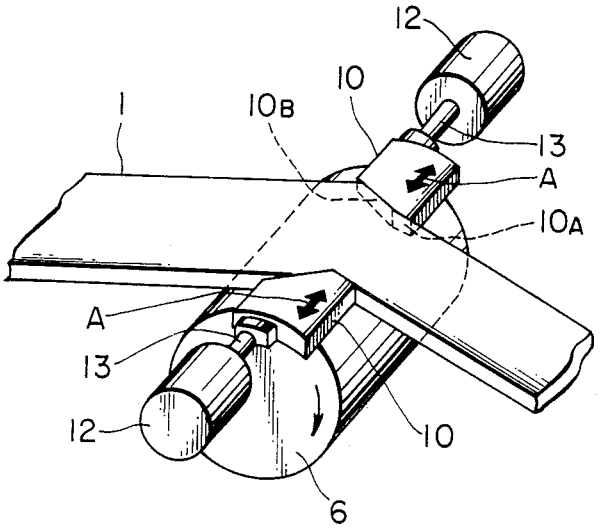
FIG. 4 is a perspective view of the essential portions showing the apparatus shown in FIG. 3.
Figure 6:
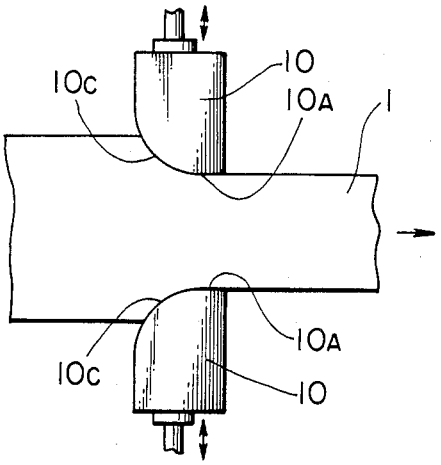
FIG. 6 shows another example of the press tool.

As shown in FIG. 4, the press tools 10 are disposed at opposite sides of the slab 1 in opposed relationship to each other, and each of opposing surfaces is formed by a plane 10A perpendicular to the direction of expansion and shrinkage of the press tool 10 (hereinafter referred to as a "perpendicular surface") and a plane 10B inclined outwardly in looking from the inlet of the slab (hereinafter referred to as an "inclined surface"). The press surfaces of the press tools 10 may be formed by a perpendicular surface 10A and an arc portion 10C as shown in FIG. 6.

Furthermore, each of the press tools 10 is formed to have a thickness more than the plate thickness of the slab 1, and the bottom face thereof, i.e. the face opposed to the turning roll 6 is formed into a surface shape following the outer peripheral surface of the turning roll 6. Each of the press tools 10 is solidly secured to the forward end portion of a cylinder rod 13 of a cylinder 12. The cylinder 12 is operated to cause the press tools 10 to slide on the turning roll 6 and repeat the expanding and shrinking actions in directions indicated by double-headed arrows A in FIG. 4.

The press tools 10 make the expanding and shrinking actions periodically. In FIG. 5, the shrinking action of the press tools 10 is indicated by solid lines and the expanding action is indicated by hypothetical lines. During the expanding action of the press tools 10, the slab 1 is adapted to advance in a direction indicated by an arrow B in FIG. 5A.

Now, in FIG. 5A, when the inclination of the inclined surface 10B as being the press surface of each of the press tools 10 is $\alpha$, one side amplitude of the press tools 10 is a, and the press tools 10 are vibrated by sinusoidal waves of a frequency f, a mean velocity V of the slab 1 is given by:

$$V = \frac{a \cdot f}{\tan \alpha}$$

The amplitude a, frequency f and inclination $\alpha$ may be set in a manner suitable for the feed velocity of the slab by the inlet tension roll 8A and the slab feed velocity by the outlet tension roll 8B.

Figure 5B:
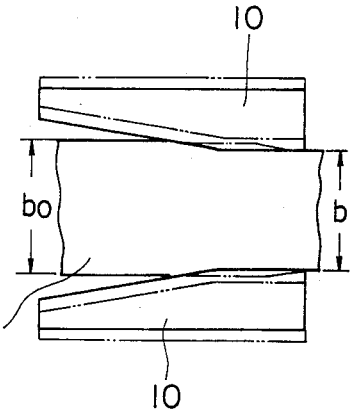

Additionally, FIG. 5B shows the case where one side amplitude a of the press tools 10 is larger than the slab width decreasing value $\Delta b/2$. The shrinking action of the press tools 10 is indicated by solid lines, while, the expanding action is indicated by hypothetical lines. In that case, the velocity V of the slab 1 is determined by the feed velocities by the pinch rolls 4 and 5. Furthermore, as shown in FIG. 5A, even when the one side amplitude a of the press tools 10 is smaller than the slab width decreasing value Δ/2, the feed velocity for the slab 1 may be determined by the feed velocities of the pinch rolls 4 and 5.

In the width decreasing apparatus 2 according to this embodiment, the slab 1 cannot proceed during the shrinking action of the press tools 10 and proceeds during the expanding action of the press tools 10, thus making the intermittent actions. Therefore, in order to convey the slab 1 to the outlet side even when the slab 1 is not delivered from the slab width decreasing apparatus 2 (during the shrinking action of the press tools 10), it is desirable to form loops 1A between the inlet pinch rolls 4 and the tension roll 8A and between the tension roll 8B and the outlet tension rolls 5, respectively.

The following advantages can be offered by this embodiment.

(1) The slab 1 is curved by the turning roll 6 to be upwardly convex and pressed in the widthwise direction by the press tools 10 in such a state as described above, whereby the buckling load becomes high, so that the width of the slab 1 can be decreased without being buckled.

(2) A tension perpendicular to the width decreasing direction is applied to the slab 1, so that the width decreasing effect is high.

(3) Differing from the example of the prior art, in which the rolling is conducted by the vertical type rolls, the slab 1 is pressed by the press tools 10 each provided with the plane (10A) perpendicular to the width decreasing direction or the plane (10B) almost similar thereto, whereby the dogbones occur close to the center of the slab, so that the width spreads are small when the horizontal rolling is conducted during the succeeding process, thus improving the efficiency of adjusting the width and the yield to a considerable extent.

Additionally, the above embodiment has shown that the press tools 10 are operated by the cylinder 12 to perform the expanding and shrinking actions, however, the present invention need not necessarily be limited to this, and the press tools 10 may be operated by mechanical means utilizing a crank or the like to perform the expanding and shrinking actions.

In the above embodiment, the surface of the turning roll 6 has been uniformly flat in the axial direction, however, the surface of the turning roll 6 may assume a concave crown in the axial direction to further improve the buckling preventing effect. Furthermore, if the surface of the turning roll 6 is ceramic-coated, then the heat resistance of the turning roll 6 can be improved and temperature of the slab 1 can be effectively prevented from lowering.

Figure 7:
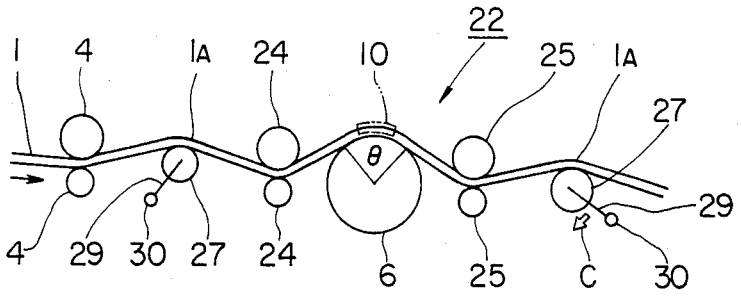
FIG. 7 shows a second embodiment of the apparatus for decreasing the width of a slab according to the present invention.

FIG. 7 shows an apparatus for working the method of decreasing the width of a thin slab according to the first aspect of the present invention, and the second embodiment of the apparatus for decreasing the width of a thin slab according to the second aspect of the present invention.

In an apparatus 22 for decreasing the width of a thin slab according to the second embodiment as shown in FIG. 7, in place of the tension rolls 8 (8A and 8B) in the first embodiment, pinch rolls 24 and 25 as being tension applying devices are provided at positions spaced apart from the turning roll 6 and in front and at the back of the turning roll 6. Further, loopers 27 are provided in front of the pinch rolls 24 and at the back of the pinch rolls 25, respectively, whereby, in each of the loopers 27, a looper support arm 29 is rocked about a pivot 30, so that a loop 1A can be adjusted. More specifically, during the shrinking action of the press tools 10, the looper support arm 29 is rocked in a direction indicated by an arrow C, whereby the slab on the outlet side is loosened, so that the conveyance of the slab to the succeeding process is not hindered.

Since the other aspects are similar to those in the previous embodiment, detailed description will not be repeated.

In this second embodiment, in addition to the effects (1)–(3) in the first embodiment, the slab on the inlet and outlet sides is not slackened by virtue of the loopers 27, so that such disadvantages are not presented that the loop 1A is enlarged to swing and sag.

Figure 8:
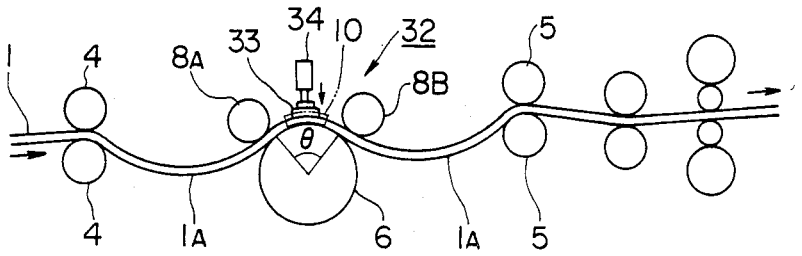
FIG. 8 shows a third embodiment of the present invention.

FIG. 8 shows the apparatus for working the method of decreasing the width of a thin slab according to the first aspect of the present invention, and the third embodiment of the apparatus for decreasing the width of a thin slab according to the second aspect of the present invention.

An apparatus 32 for decreasing the width of a thin slab as shown in FIG. 8 features that a buckling preventive jig 33 is provided directly upwardly of the turning roll 6, so that the slab 1 to be pressed by the press tools 10 in the widthwise direction thereof can be urged against the turning roll 6. Since the other aspects are similar to those in the first embodiment of the second aspect of the present invention (Refer to FIGS. 3 and 4), same reference characters are used to designate same or similar parts, so that the detailed description need not be repeated.

This buckling preventive jig 33 is formed into a flat plate in looking from the outside, a surface thereof opposed to the slab 1 is formed into a surface matching the outer surface of the slab 1, whereby the slab 1 is urged from above by a cylinder 34.

In this embodiment, the slab 1 to be pressed by the press tools 10 in the widthwise direction thereof is clamped in the vertical direction between the turning roll 6 and the buckling preventive jig 33, so that occurrence of buckling during press work can be reliably prevented.

Figure 9:
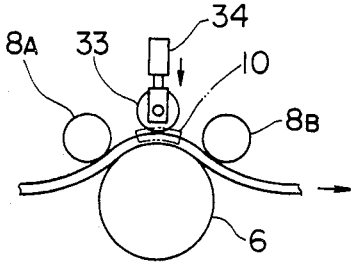
FIG. 9 shows a fourth embodiment of the present invention.

FIG. 9 shows a fourth embodiment of the apparatus for decreasing the width of a thin slab, in which the buckling preventive jig is of a turning roll type.

This embodiment can offer the following effects in addition to the effects offered by the third embodiment.

More specifically, the buckling preventive jig 33 is composed of the turning roll, whereby friction generated between the slab 1 and the buckling preventive jig 33 becomes very small as compared with the third embodiment, so that there will be no necessity for considering the wear of the buckling preventive jig 33 and a load acting on the cylinder 34 for causing the buckling preventive jig 33 to slide in the direction of conveyance of the slab.

In consequence, the present invention is advantageous in that occurrence of buckling is prevented during the decrease of the width of the thin slab, so that the value of decreasing the width can be increased and the slab can be decreased in its width into one having a satisfactory section.

Description will now be given of another embodiment of the present invention with reference to FIGS. 10 to 12.

Figure 10:
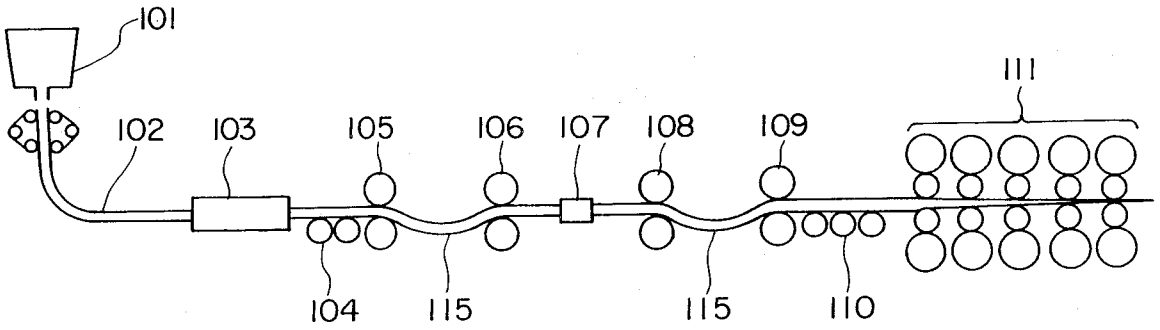
FIG. 10 is a flow diagram of the continuous casting equipment-hot finish rolling equipment, wherein the apparatus for decreasing the width of a slab according to the present invention is employed.

Referring to FIG. 10, a thin slab 102, which has been cast in a continuous casting equipment 101, is passed through a heat holding furnace 103, conveyed on a table 104, passed through pinch rolls 105, and is reliably supplied to a section of a width decreasing apparatus 107 according to the present invention. Pinch rolls 106 and 108 make free loops 115. Pinch rolls 109 feed the slab across table 110 and through a rolling mill 111.

Figure 11:
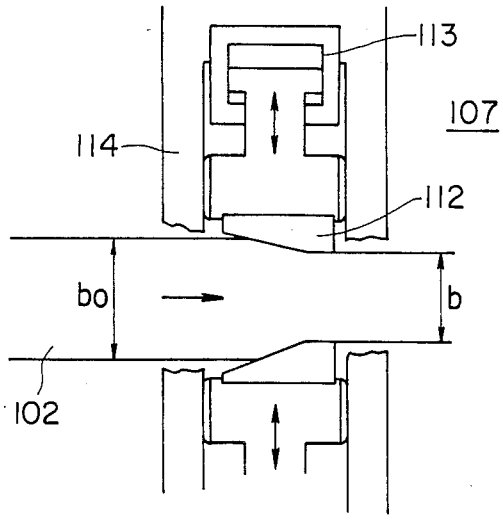
FIG. 11 is a sectional view showing the main body of the apparatus for decreasing the width of a slab.

As may be shown in FIGS. 4 and 6 and as shown in FIG. 11, the main body of the width decreasing apparatus 107 principally includes:

hydraulic jacks 113 each provided with a press tool 112 having a portion directly contacting the thin slab 102, which is divided into two including a tapered part and a straight-lined part (any other shape will do, only if it is almost planar) in the direction of flow of the material, for periodically actuating the press tool 112 to operate in a direction perpendicular to the direction of flow of the material (indicated by an arrow in the drawing); and housings 114 for receiving the press loads.

In addition to the above, the width decreasing apparatus 107 includes a device (not shown) for controlling the position of the hydraulic jacks 113 and a section of a reduction position setting device (a screw reduction by worms, for example) for determining the positions of the hydraulic jacks 113 as a whole in accordance with a width $b_o$ of the thin slab 102 on the inlet side. Furthermore, the device for applying the vibrating action may be a mechanical one, but not the hydraulic type.

Figure 12:
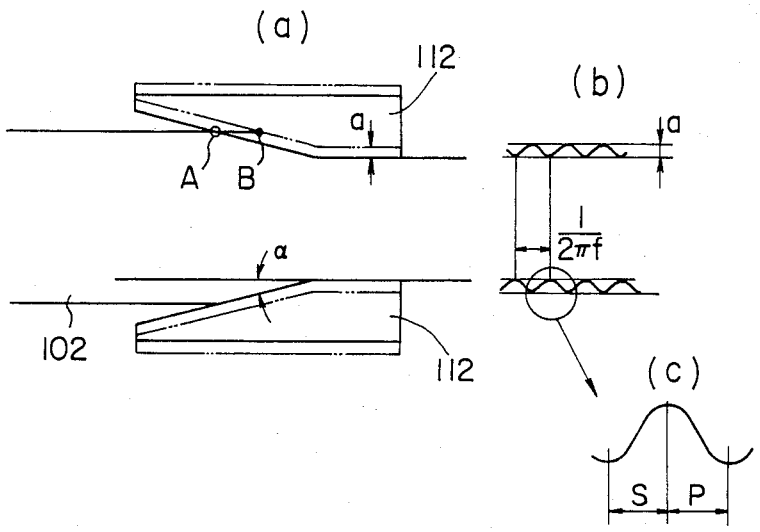
FIG. 12 is an explanatory view explaining the shrinking action.

FIG. 12 is an explanatory view illustrating the actions of the press tools 112 and the thin slab 102.

In FIG. 12, solid lines indicate a state where a width decreasing action S is completed. Subsequently, the press tools 112 are relieved to the direction of the opening by a value a of width decrease, and the slab 102 is moved during action P from a point A to a point B by means of a slab push device. More specifically, the thin slab 102 proceeds intermittently. When the press tools 112 are vibrated by sinusoidal waves shown in FIG. 12(C) of the width decrease a and a frequency f, a value of the mean velocity of advance $\nu$ is given by $$\nu = af/\tan \alpha$$

In consequence, the values of a, f and $\alpha$ may be determined, so that the production can be satisfied. However, since the slab 2 makes the intermittent proceeding action during the width decreasing process as described above, loops 115 are provided at the inlet and outlet sides of the main body of the width decreasing apparatus 107 in order to perform the continuous conveyance of the slab 102 from the continuous casting equipment 101 on the inlet side and the continuous supply of the slab 102 to a hot finish rolling equipment 111 on the outlet side. These loops 115 can be formed since the slab is as thin as 30 mm, etc. The length of the loop 115 is a length while the slab 102 is stopping during the width decreasing process S. For example, if, in the aforesaid sinusoidal wave, f is 1 Hg and the velocity at the inlet side of the main body of the width decreasing apparatus 107 is 10 m/mm, then a net value may be 10 m/60 (min)×0.5 (sec)=0.084 m (84 mm). Even if a certain allowance may be added to the net value, the resultant value will not be so large, with the result that a free deflection of the thin slab, namely, a free loop should be sufficient. The formation of the free loops 115 is made by pinch rollers 106 and 108.

Figure 13:
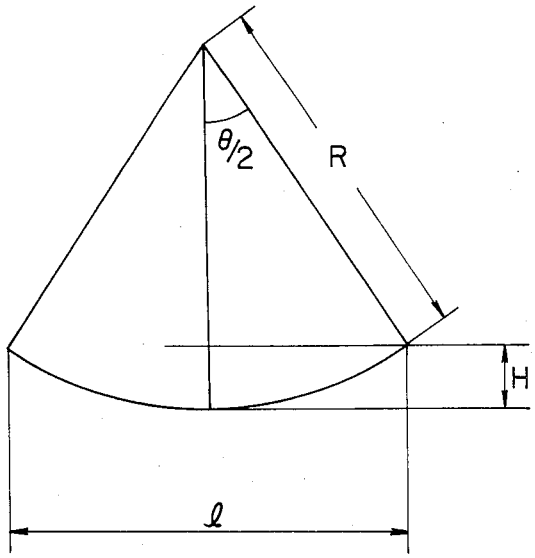
FIG. 13 is an explanatory view when the loopers are used.

Herein, a distance l provided for absorbing the flee loops between the pinch rollers (105–106, 108–109) and a height H of the free loops are sought by use of the following conditions and the formulae. While, the loop is sought on condition that the loop sags by a curve R as shown in FIG. 13. The following is the rough calculation thereof.

If:
a required loop length 90 mm
dimensions of the hot thin slab
thickness 30 mm×width 1500 mm
$E=1.5\times10^3\ Kq/mm$ (1100° C.)
$H=5\ wl^4/384\ EI$ (w: weight of a unit length of slab)
$R\theta-2R\sin\theta/2=90$ (mm)
$H\doteq R(1-C\ \mathrm{co}\ \theta/2)$,
then,
$l\div5$ m, $H\div570$ mm.

Even if a difference in the conditions of support at opposite ends are taken into account, there is not such a large difference.

In consequence, an equipment compact in size can be brought to completion.

According to the present invention, the reduction to a considerable extent and the width decrease of the thin slab is carried out to produce a thin slab having a satisfactory section by the press type width decreasing apparatus, so that the intermittency of the width decreasing actions can be absorbed by the free loops of the thin slab on the inlet and outlet sides. Hence, the present invention can offer such an advantage that the combination of the continuous casting equipment with the hot finish rolling equipment can be attained by a simplified arrangement.

What is claimed is:

1. Apparatus for decreasing the width of an indefinite length thin slab having a generally rectangular cross sectional configuration as seen in a cross-sectional plane perpendicular to the length, with said rectangular configuration being defined by a generally uniform height in the direction of the edges of the slab and a generally uniform width in the direction transverse to the length of the slab that is many times larger than the height, comprising:

means for conveying the thin slab in a conveying direction aligned with the indefinite length of the slab and perpendicular to a transverse direction aligned with the slab width;

curved support means defining a planar curved support area that is curved in the conveying direction, and rectilinear in the transverse direction, said support means supporting only a portion of the length of the slab in a corresponding curvature for substantially the moment of inertia of the increasing slab with respect to buckling in the transverse direction;

two press tools having, respectively, slab engaging surfaces facing each other, spaced apart in the transverse direction and located relative to said means for conveying and said curved support means for respectively engaging the opposite edges of the slab curvature;

each of said slab engaing surfaces having a first surface portion that extends a substantial distance generally parallel to said conveying direction and perpendicular to said transverse direction, and a second surface portion extending upstream from said first surface portion relative to the conveying direction and said second surface portions converging toward each other in the conveying direction;

means for adjusting the transverse direction spacing between said press tools for adjusting the spacing between their opposed slab engaging surfaces to the width of said slab;

power means for continuously moving said press tools toward and away from each other in the tranverse direction with a transverse force sufficient to produce the width reduction and hold said slab portion stationary, while said tools move toward each other and with a range of total tranverse movement generally corresponding to the reduction; and said means for conveying providing movement of the slab portion in the conveying direction while said press tools move apart and permitting the slab portion to remain generally stationary relative to the conveying direction while said press tools move toward each other to thereby provide intermittent feed of advancing slab portions in the conveying direction while alternating with intermittent reducing of the width of the advancing slab portions.

2. The apparatus of claim 1, wherein said conveying means includes means for forming free loop portions in the slab immediately upstream and downstream of said curved support means and continuously feeding said slab at a generally uniform velocity upstream and downstream respectively of said means for forming loops.

3. The apparatus of claim 1, including means for tensioning and stretching said slab portion at least during the movement of said press tools toward each other.

4. The apparatus of claim 3, wherein said means for tensioning includes pinch rolls for gripping the slab therebetween.

5. The apparatus of claim 1, wherein said curved support means includes a rotating cylindrical roll having an axis of rotation parallel to the tranverse direction.

6. The apparatus of claim 5, wherein each of said press tools has a surface immediately adjacent and of a complementary curvature to the outer cylindrical surface of said roll, with said last mentioned press tool surface joining and being generally perpendicular to said slab engaging surface of the press tool.

7. The apparatus of claim 6, further including buckling preventing means disposed tranversely between said press tools and spaced from said curved support means a distance sufficient to contact the surface of the slab opposite to the surface of the slab engaging said curved support means to increase the maximum buckling load capacity of the slab in the tranverse direction.

8. The apparatus of claim 1, further including buckling preventing means disposed tranversely between said press tools and spaced from said curved support means a distance sufficient to contact the surface of the slab opposite to the surface of the slab engaging said curved support means to increase the maximum buckling load capacity of the slab in the transverse direction.

9. A method for decreasing the width of an indefinite length thin slab having a generally rectangular cross sectional configuration as seen in a cross-sectional plane perpendicular to the length, with said rectangular configuration being defined by a generally uniform height in the direction of the edges of the slab and a generally uniform width in the direction transverse the length of the slab that is many times larger than the height, comprising:

conveying the thin slab in a conveying direction aligned with the indefinite length of the slab;

providing a curved support defining a planar curved support area that is curved in the conveying direction, and rectilinear in the transverse direction;

supporting only a portion of the length of the slab in a correspoinding curvature for substantially increasing the moment of inertia of the slab with respect to buckling in the transverse direction;

engaging the edges of the curved slab portion with two press tools having, respectively, slab engaging surfaces facing each other, spaced apart in the transverse direction and located relative to said means for conveying for respectively engaging the opposite edges of the slab, each of said slab engaging surfaces having a first surface portion that extends a substantial distance generally parallel to said conveying direction and perpendicular to said transverse direction, and a second surface portion extending upstream from said first surface portion relative to the conveying direction and so that said second surface portion converge toward each other in the conveying direction;

adjusting the transverse direction spacing between said press tools for adjusting the spacing between their opposed slab engaging surfaces to the width of said slab;

continuously moving said press tools toward and away from each other in the tranverse direction with a transverse force sufficient to produce the width reduction and hold said slab portion stationary while said tools move toward each other and with a range of total movement generally corresponding to the width reduction; and conveying the slab portion in the conveying direction while said press tools move apart and permitting the slab portion to remain generally stationary relative to the conveying direction while said press tools move toward each other to thereby intermittently feed advancing slab portions in the conveying direction while alternating with intermittently reducing the width of the advanding slab portion.

10. The method of claim 9, said conveying including providing free loop portions in the slab immediately upstream and downstream of said supporting and continuously feeding said slab at a generally uniform velocity upstream and downstream respectively of the loops.

11. The method of claim 9, including tensioning and stretching said slab portion at least during the movement of said press tools toward each other.

12. The method of claim 11, further including supporting and contacting the surface of the slab opposite to the surface of the curved support to increase the maximum buckling load capacity of the slab in the transverse direction.

13. The method of claim 9, further including supporting and contacting the surface of the slab opposite to the surface of the curved support to increase the maximum buckling load capacity of the slab in the transverse direction.

* * * * *